US010927725B2

(12) United States Patent
Cecil

(10) Patent No.: US 10,927,725 B2
(45) Date of Patent: Feb. 23, 2021

(54) TWO PLANE ACCESSORY MOUNTING WITH SLIDING PILOT INTERFACE

(71) Applicant: CUMMINS INC., Columbus, IN (US)

(72) Inventor: Adam C. Cecil, Columbus, IN (US)

(73) Assignee: Cummins Inc., Columbus, IN (US)

( * ) Notice: Subject to any disclaimer, the term of this patent is extended or adjusted under 35 U.S.C. 154(b) by 348 days.

(21) Appl. No.: 15/768,640

(22) PCT Filed: Oct. 28, 2016

(86) PCT No.: PCT/US2016/059325
§ 371 (c)(1),
(2) Date: Apr. 16, 2018

(87) PCT Pub. No.: WO2017/095352
PCT Pub. Date: May 4, 2017

(65) Prior Publication Data

US 2018/0298796 A1 Oct. 18, 2018

Related U.S. Application Data

(60) Provisional application No. 62/247,912, filed on Oct. 29, 2015.

(51) Int. Cl.
*F01M 1/02* (2006.01)
*F02B 63/06* (2006.01)
*F01M 11/03* (2006.01)

(52) U.S. Cl.
CPC ..... *F01M 1/02* (2013.01); *F02B 63/06* (2013.01); *F01M 11/03* (2013.01);
(Continued)

(58) Field of Classification Search
CPC . F01M 1/02; F01M 11/03; F01M 5/10; F01M 5/12; F01M 2001/0253;
(Continued)

(56) References Cited

U.S. PATENT DOCUMENTS 4,321,896 A 3/1982 Kasting
4,459,950 A 7/1984 Kasting
(Continued)

FOREIGN PATENT DOCUMENTS

CN 10-4456037 3/2015
WO 2014/057847 4/2014

OTHER PUBLICATIONS

International Preliminary Report on Patentability received for PCT Patent Application No. PCT/US2016/059325, dated May 11, 2018, 7 pages.
(Continued)

*Primary Examiner* — Michael R Mansen
*Assistant Examiner* — Robert T Reese
(74) *Attorney, Agent, or Firm* — Faegre Drinker Biddle & Reath LLP

(57) ABSTRACT

System and methods mount an accessory to an engine block having a pilot bore aligned with a first plane and sealing surfaces aligned to a second plane different than the first plane. The accessory includes a sliding pilot for interfacing with the pilot bore that is capable of sliding in an "x" direction yet fixed in a "y" direction with respect to the accessory housing. Interfacing the sliding pilot in a mounting position with the pilot bore along a "z" direction locates the accessory with respect to the engine block in the "y" and "z" directions. Fastening the accessory to the sealing surfaces of the engine block locates the accessory in the "x" direction with sufficient precision to mitigate gear backlashing and providing one or more fluid seals between the accessory and the engine block.

20 Claims, 10 Drawing Sheets

(52) U.S. Cl.
CPC ..... *F01M 2001/0253* (2013.01); *F01M 2001/0284* (2013.01); *F01M 2001/0292* (2013.01)

(58) Field of Classification Search
CPC .... F01M 2001/0284; F01M 2001/0292; F02B 63/06; F02B 67/04; F02B 75/22; F02F 7/0039; F02F 7/0046; F02F 7/0051; F02F 7/0065; F02F 7/0068; F04B 17/05
See application file for complete search history.

(56) References Cited

U.S. PATENT DOCUMENTS 4,573,439 A 3/1986 Kasting
4,958,997 A 9/1990 Harwath
5,282,446 A * 2/1994 Whitefield ..... F01M 1/02 123/198 C
5,771,854 A 6/1998 Barton
6,324,744 B1 * 12/2001 Banks ..... F02F 7/0046 123/195 A
7,086,372 B2 8/2006 Takiguchi et al.
8,807,111 B2 8/2014 Hughes
8,845,313 B2 9/2014 Graham et al.
2002/0062810 A1 * 5/2002 Matsuda ..... F02B 75/243 123/196 R
2015/0114336 A1 * 4/2015 Matsuda ..... F01M 1/02 123/196 A
2015/0218983 A1 * 8/2015 Watanabe ..... F04C 13/005 210/130

OTHER PUBLICATIONS

International Search Report and Written Opinion dated Jan. 3, 2017 in PCT/US2016/059325.

* cited by examiner

TWO PLANE ACCESSORY MOUNTING WITH SLIDING PILOT INTERFACE

RELATED APPLICATIONS

The present application is a national phase filing under 35 U.S.C. § 371 of International Application No. PCT/US2016/059325, titled "TWO PLANE ACCESSORY MOUNTING WITH SLIDING PILOT INTERFACE," filed on Oct. 28, 2016, which claims the benefit of priority to U.S. Provisional Application No. 62/247,912, filed with the U.S. Patent and Trademark Office on Oct. 29, 2015, the entire disclosures of which being expressly incorporated herein by reference.

FIELD OF THE DISCLOSURE

The present disclosure generally relates to methods and systems for mounting an accessory to an engine block and, more particularly, to mounting an external lube pump to an internal combustion engine block using two-plane accessory mounting with a sliding pilot interface.

BACKGROUND OF THE DISCLOSURE

In some engine systems, external gear driven accessories are conventionally mounted to the engine block using a pilot diameter to accurately locate an "x" position and a "y" position with sufficient precision to operate the engine while mitigating lash between an engine drive system and an accessory (e.g., an accessory gear). One or more bolts secure the accessory to a mating flange on the engine block to locate a "z" position and optionally provide a sufficient seal to prevent leaks, for example, of lube oil. This technique is widely used and facilitates efficiency during assembly.

The conventional technique is limited when used for an accessory lube pump, however. For example, to provide sufficient "x-y" stability and seal along the "z" position during operation, the lube oil conduit from the oil pan to the lube pump in a conventional engine block requires tortuous paths, such as an elbow or sharp turn, to transfer the lube oil into the lube pump. Furthermore, the lube oil conduit from the lube pump requires another elbow or sharp turn in the conventional engine block to transfer the lube oil from the lube pump to a lube oil cooler, for example. Tortuous lube oil conduits restrict oil flow and can increase fluid transfer pressure drop and parasitic losses, as well as reduce fuel economy.

SUMMARY OF THE DISCLOSURE

In one embodiment of the present disclosure an engine includes an engine block, where the engine block includes a pilot bore aligned to a first plane, a gear chamber exposed to the pilot bore, one or more engine block sealing surfaces aligned to a second plane orthogonal to the first plane, one or more fastener provisions, and one or more fluid conduits extending from the one or more engine block sealing surfaces. The engine also includes an engine drive system at least partially housed in the engine block and a lube pump accessory mounted to the engine block.

The lube pump accessory can include a pump housing, a drive mechanism, a sliding pilot, one or more pump sealing surfaces that can have a complementary shape to one or more corresponding engine block sealing surfaces, an inlet extending from one or more pump sealing surfaces, and an outlet extending from one or more pump sealing surfaces. The drive mechanism can be mounted in the engine block.

The sliding pilot can interface with the pilot bore to establish a "z" position and a "y" position for the lube pump accessory with respect to the engine block. The sliding pilot is configured to travel in an "x" direction with respect to the pump housing during mounting of the lube pump accessory. In one example, the pilot bore of the engine block can form a sliding fit to allow travel of the sliding pilot in a "z" direction.

The engine can also include one or more fasteners positioned in one or more fastener provisions of the engine block that can secure the lube pump accessory to the engine block. In one example one or more of the fasteners can secure the lube pump accessory to the engine block in the "x" direction. The engine can also include a clearance in the "x" direction between the engine block sealing surfaces and the pump housing. The clearance can allow for a space or gap to be made available for avoiding damage to a sealing gasket between the pump housing of the lube pump accessory and the engine block sealing surfaces while sliding the drive mechanism of the lube pump accessory in a "z" direction through the pilot bore during mounting.

Another embodiment of the present disclosure includes an accessory that can be mounted on an engine block. The accessory includes a housing with a support boss, one or more mounting surfaces, and one or more fluid conduits extending from the one or more mounting surfaces. The accessory also includes a driveshaft that extends from the support boss in a "z" direction for insertion into the engine block when mounting the accessory to the engine block. The accessory further includes a sliding pilot that interfaces with the support boss, where the sliding pilot is capable of travel in an "x" direction yet fixed in a "y" direction with respect to the support boss. The sliding pilot includes an inner profile and an outer profile in an "x-y" plane.

The accessory can also include one or more fasteners for securing the accessory to the engine block in the "x" direction. In one example the one or more mounting surfaces maintain one or more seal gaskets. When the one or more fasteners secure the accessory to the engine block, the one or more seal gaskets are compressed between the one or more mounting surfaces and the engine block to form a fluid tight seal.

In one example the support boss includes two flat surfaces along an outer profile. An inner profile of the sliding pilot can include two flat edges complementary to the two flat surfaces of the support boss. In one example the flat edges extend in an "x" direction. The outer profile of the support boss can also include two curved edges. The two curved edges can correspond to two curved edges located along the inner profile of the sliding pilot.

The accessory can also include a retaining nut secured to the driveshaft securing the drive mechanism to the accessory in a "z" direction.

In another exemplary embodiment, an engine includes: an oil pan as a fluid source; an engine block including a pilot bore aligned to a first plane, a gear chamber exposed to the pilot bore, one or more engine block sealing surfaces aligned to a second plane orthogonal to the first plane, one or more fastener provisions, and one or more fluid conduits extending from the one or more engine block sealing surfaces, at least one of the fluid conduits being in fluid communication with the oil pan, at least one of the fluid conduits being in fluid communication with a downstream engine lubrication system; a drive system at least partially housed in the engine block; a lube pump accessory mounted to the engine block including a pump housing, a drive mechanism, a sliding pilot, one or more pump sealing surfaces having a complementary shape to the one or more corresponding engine block sealing surfaces, an inlet extending from one or more pump sealing surfaces, and an outlet extending from one or more pump sealing surfaces, wherein the drive mechanism is mounted in the engine block, the sliding pilot interfaces with the pilot bore to establish a "z" position and a "y" position for the lube pump accessory with respect to the engine block, and wherein the sliding pilot is configured to travel in an "x" direction with respect to the pump housing before mounting and during mounting; and one or more fasteners positioned in the one or more fastener provisions of the engine block and securing the lube pump accessory to the engine block, wherein when the one or more fasteners maintain a seal between the one or more pump sealing surfaces and the one or more engine block sealing surfaces, an "x" position for the lube pump accessory with respect to the engine block is established and the drive mechanism is interfaced with the drive system, wherein the established "x" and "y" positions are toleranced to mitigate gear backlash between the drive mechanism of the lube pump accessory and a drive train.

In another exemplary embodiment, an accessory for mounting to an engine block includes: a housing including a support boss, one or more mounting surfaces maintaining one or more gaskets, and one or more fluid conduits extending from the one or more mounting surfaces, wherein the support boss includes two flat surfaces; a driveshaft extending from the support boss in a "z" direction for insertion into the engine block when mounting the accessory to the engine block; a sliding pilot interfacing with the support boss, the sliding pilot being capable of travel in an "x" direction yet fixed in a "y" direction with respect to the support boss, the sliding pilot including an inner profile and an outer profile in an "x-y" plane, wherein the inner profile includes two flat edges complementary to the support boss flat surfaces and extending in the "x" direction, and wherein the sliding pilot is capable of travel in the "x" direction to a mounting position to prevent damage to the one or more gaskets during mounting of the accessory onto the engine block; and one or more fasteners for securing the accessory to the engine block, wherein when secured, the one or more gaskets are compressed between the one or more mounting surfaces and the engine block to form a fluid tight seal.

In another example of the present disclosure, a method is provided that includes positioning an accessory near an engine block where the accessory includes a sliding pilot having travel in an "x" direction yet fixed in a "y" direction. The method can also include positioning the sliding pilot into a mounting position for mounting on the engine block at a limit of travel in the "x" direction.

The method can include sliding the accessory into a pilot bore of the engine block in a "z" direction until the sliding pilot is seated in the pilot bore. As a result of the sliding, the accessory can be located in the "z" direction and the "y" direction with respect to the engine block. In one example sliding the accessory into the pilot bore of the engine block includes providing a clearance in the "x" direction to allow the sliding pilot to be seated in the pilot bore without damaging one or more seal gaskets with the accessory.

The method can also include fastening the accessory to the engine block in the "x" direction to locate the accessory in the "x" direction with respect to the engine block. The fastening can move the sliding pilot into a mounted position at another limit of travel in the "x" direction. In one example the method includes mating one or more engine block sealing surfaces with one or more accessory sealing surfaces when fastening the accessory to the engine block.

Another exemplary method includes: positioning an accessory near an engine block, the accessory including one or more accessory sealing surfaces for maintaining one or more gaskets and a sliding pilot having travel in an "x" direction yet fixed in a "y" direction, wherein the engine block includes a pilot bore and one or more engine block sealing surfaces having a complementary shape to the one or more accessory sealing surfaces; positioning the sliding pilot into a mounting position at a limit of travel in the "x" direction; sliding the accessory into the pilot bore until the sliding pilot is seated in the pilot bore to locate the accessory in a "z" direction and the "y" direction with respect to the engine block, wherein sliding the accessory with the sliding pilot in the mounting position allows the sliding pilot to be seated in the pilot bore without damaging the one or more gaskets with the accessory; and fastening the accessory to the engine block in the "x" direction to locate accessory in the "x" direction with respect to the engine block, wherein fastening the accessory moves the sliding pilot into a mounted position at another limit of travel in the "x" direction.

DETAILED DESCRIPTION OF THE EMBODIMENTS

While some embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

As used herein throughout, an "x" direction is a direction substantially along an "x" axis. A "y" direction and a "z" direction are similarly defined for "y" and "z" axes, respectively. Further, an "x" direction surface is a surface substantially in a plane perpendicular to the "x" axis. A "y" direction surface and a "z" direction surface are similarly defined with respect to a "y" and a "z" axes, respectively. Yet further, an "x" flange means a flange having a principal interface surface substantially in a plane perpendicular to the "x" axis. A "y" flange and a "z" flange are similarly defined with respect to the "y" and the "z" axes, respectively.

Also, as used herein throughout, the terms "above, "top," "below," "bottom," "left," "right," "up," "front," "back," "down," and similar relative directions or orientations are defined consistent with the key 19 shown in FIG. 1. The example key 19 is oriented with respect to an accessory mounted with the engine block 10. Although one possible orientation is described herein, other suitable orientations of the accessory and/or the engine block 10 are also contemplated.

Further, as used herein throughout, the terms "fixed" or "located" are defined to mean that a component does not substantially move with respect to another component as a person having ordinary skill in the art would expect for those components. For example, a gear "fixed" with respect to another gear can travel, but no more than approximately 0.1 millimeter. In another example, a screw "fixed" with respect to a screw provision can travel, but no more than approximately 1 millimeter.

Figure 1:
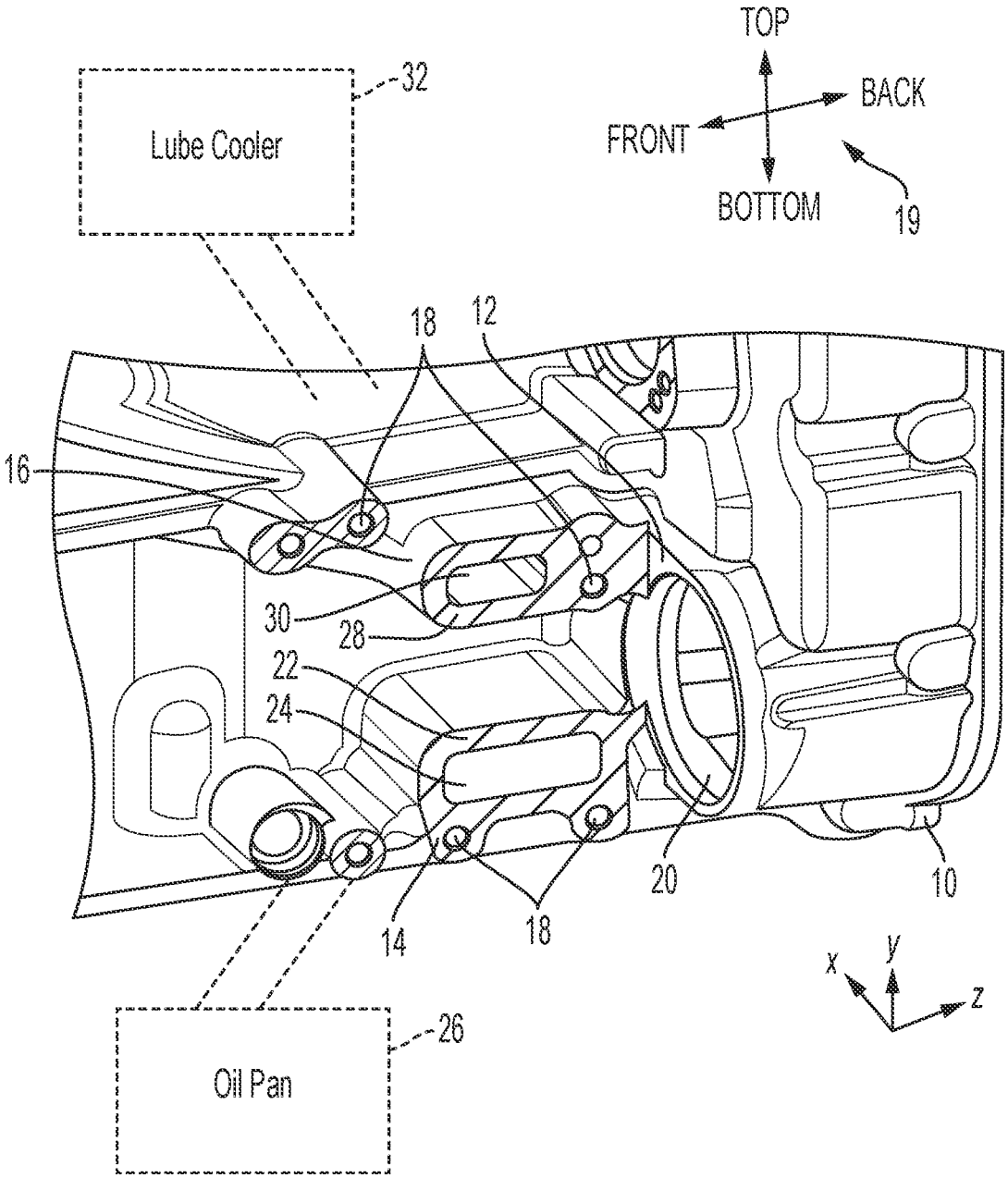
FIG. 1 is a partial isometric view of an engine block adapted for two-plane accessory mounting, according to some embodiments.

FIG. 1 shows, at least partially, an engine block 10 configured for two-plane accessory mounting or installation. The example engine block 10 houses a crankshaft and related power delivery gearing (not shown) as an interface to deliver power to a mounted accessory. In additional or alternative embodiments, the power delivery interface may include, for example, an engine drive system, a gear sprocket, a pulley, or any suitable combinations and variations thereof to deliver power to the mounted accessory. As shown, the example engine block 10 includes a pilot bore 12, an inflow interface 14, an outflow interface 16, and a plurality of fastener provisions 18 to mount an accessory, in particular a lube pump accessory, for use during operation of the engine.

The example pilot bore 12 includes a pilot bore interface 20 having a pilot bore diameter to facilitate precise locating of an accessory mounted on the engine block 10. The example pilot bore 12 forms an aperture in an engine block wall between an engine block exterior and an engine block interior housing the accessory power gearing. In some instances, the example pilot bore 12 is manufactured to form a sliding fit with a corresponding accessory pilot. A sliding fit allows an accessory to move in one direction while being located or fixed in one or more other directions. For example, a sliding fit with the pilot bore 12 allows travel in the "z" direction while being located or fixed in at least one of the "x" and "y" directions during assembly. Precise alignment of an accessory in the "x" and/or "y" direction prevents or mitigates backlash and noise during operation caused primarily by clearance between the teeth of a gear-to-gear interface in an "x-y" plane, for example, between an accessory drive mechanism and the power delivery gearing housed in the engine block 10.

The example inflow interface 14 includes an inflow sealing surface 22 and an inflow conduit 24 formed in the engine block 10 and extending through the inflow sealing surface. As shown, the inflow sealing surface 22 is a flat, planar surface configured to mate with and seal against a corresponding accessory interface to contain the flow of fluid from the inflow conduit 24 to the accessory.

In the illustrated embodiment, the inflow conduit 24 extends from the inflow sealing surface 22 into the engine block 10. The example inflow conduit 24 extends into and is in fluid communication with a fluid source, such as oil pan 26, as shown schematically below the inflow sealing surface 22. However, other sources of fluid are also contemplated in other embodiments (not shown).

The example outflow interface 16 includes an outflow sealing surface 28 and an outflow conduit 30 formed in the engine block 10 and extending through the outflow sealing surface. As shown, the outflow sealing surface 28 is a flat, planar surface configured to mate with and seal against a corresponding accessory interface to contain the flow of liquid from the accessory to the outflow conduit 30.

As illustrated the outflow conduit 30 extends from the outflow sealing surface into the engine block 10. The example outflow conduit 30 extends into and is in fluid communication with an engine component, such as a lube cooler 32, as shown schematically above the outflow sealing surface 28. However, other engine components are also contemplated in other embodiments (not shown).

In some embodiments, the inflow sealing surface 22 and/or outflow sealing surface 28 may be formed in a complementary shape to corresponding accessory mating surface(s). In other embodiments (not shown), the sealing surface(s) 22, 28 are not a flat or planar shape and may include curves, grooves, texturing, other materials, and/or shoulders, for example.

In various embodiments, the inflow conduit 24 and/or the outflow conduit 30 include one or more bends between their surfaces 22, 28 and the oil pan 26 and lube cooler 32, respectively. Non-limiting examples of bends in a conduit include a bend greater than 0 degrees but less than 180 degrees, a bend greater than 90 degrees but less than 135 degrees, or a bend greater than 0 degrees but less than 90 degrees. A 180 degree bend, for example, may be "U"-shaped and would send fluid in opposite directions. Other degrees of bends are also contemplated to manage characteristics of the delivery of fluid to the accessory, such as pressure drop. In general, fluid pressure drop increases with a greater degree of bend.

As shown, the pilot bore 12 is aligned to a plane (e.g., "x-y" plane) different from or orthogonal to another plane aligned with the inflow sealing surface 22 and/or the outflow sealing surface 28 (e.g., "y-z" plane). The accessory is piloted through the pilot bore 12 in the "z" direction and sealed to the engine block 10 in the "x" direction with fasteners.

In the illustrated embodiment, a plurality of fastener provisions 18 positioned on the engine block 10 are included to secure the accessory to the engine block, at least in one direction. For example, the fastener provisions 18 are cap screw provisions. However, other types of fasteners and corresponding locations are also contemplated.

The example fastener provisions 18 are positioned in a co-planar relationship or at least in parallel planes. As shown, the engine block 10 includes four (4) fastener provisions—two fastener provisions are positioned on (e.g., formed in) the inflow sealing surface 22, one fastener provision is positioned on (e.g., formed in) the outflow sealing surface 28, and a fourth fastener provision is positioned (e.g., formed in) on another surface of the engine block 10. In other embodiments (not shown), any number of fastener provisions may be included as suitable for securing the particular accessory to a particular engine block.

Figure 2:
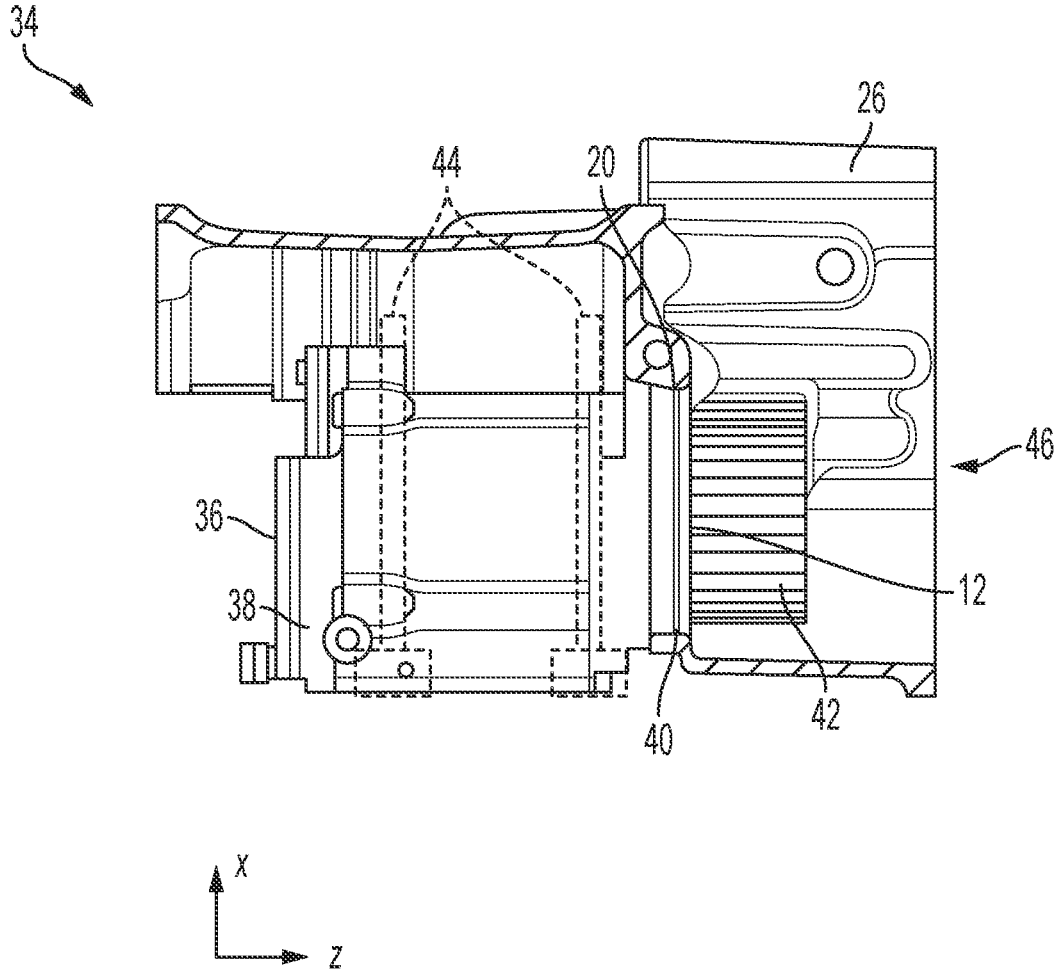
FIG. 2 is a top view of a lube pump mounted onto the engine block of FIG. 1 according to an embodiment of the present disclosure.

Referring to FIG. 2, an example lube pump assembly 34 including a lube pump accessory 36 mounted to the example engine block 10 (e.g., post assembly) from a top view is shown. In the illustrated embodiment, the lube pump accessory 36 is external to the engine block 10 and a separate component to be mounted thereto. The lube pump accessory 36 includes a pump housing 38, a sliding pilot 40, a drive mechanism 42, and fasteners 44. The drive mechanism 42 is mounted through the pilot bore 12 and into a gear chamber 46 of the engine block 10. The sliding pilot 40 in a mounted or post-assembly position interfaces in a sliding fit with the pilot bore 12 via the pilot bore interface 20. As shown, the sliding pilot 40 and the drive mechanism 42 are visible through the partially cutaway engine block 10. The example fasteners 44 extend in the "x" direction into the engine block 10.

When secured, and in cooperation with the pump housing 38 and the engine block 10, the fasteners 44 locate the lube pump accessory 36 in the "x" direction. When secured, the fasteners 44 form a fluid tight seal between the engine block 10 and the pump housing 38. As shown, the fasteners 44 are in position to secure the lube pump accessory 36 to the engine block 10. The example fasteners 44 are cap screws, although other fastener types are contemplated.

Figure 3:
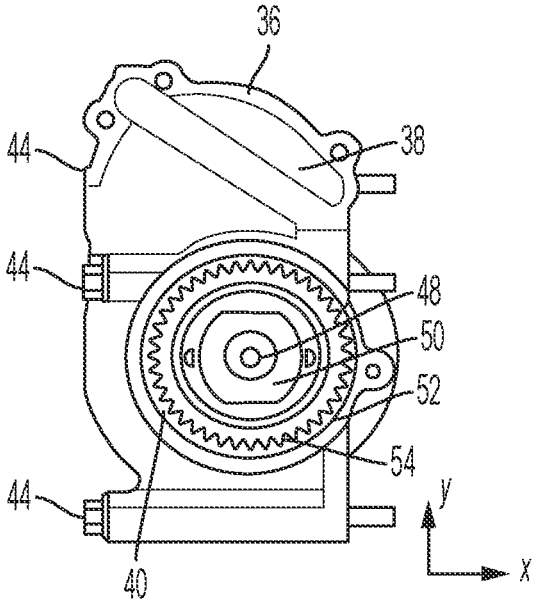
FIG. 3 is a back elevation view of the lube pump of FIG. 2 in a mounted position according to an embodiment of the present disclosure.

As can be seen in FIG. 3 (not showing the engine block), the sliding pilot 40 of the example lube pump accessory 36, from a back view, is shown in a mounted position over a pump driveshaft 48. In the mounted position, the exterior profile of the example sliding pilot 40 is coaxially aligned with the exterior profiles of the drive mechanism 42 as well as the pump driveshaft 48 in the "x-y" plane. In other embodiments (not shown), the sliding pilot 40 is not coaxially aligned with the drive mechanism 42. A retaining nut 50 is also shown secured to the pump driveshaft 48, which secures the drive mechanism 42 to the lube pump accessory 36 in the "z" direction. The fasteners 44 are shown in a mounted position extending through the pump housing 38 in the "x" direction.

In an "x-y" plane, a sliding pilot outer profile 52 circumscribes a drive mechanism outer profile 54, which allows the lube pump accessory 36 to slide into a pilot bore (e.g., pilot bore 12) of an engine block with the drive mechanism 42 leading the sliding pilot 40. In the illustrated embodiment, the example sliding pilot outer profile 52 is circular and has an outer diameter. The example drive mechanism outer profile 54 is undulating yet bounded by an outer diameter, which is less than the diameter of the sliding pilot outer profile 52. With a circular sliding pilot outer profile 52, the sliding pilot 40 may be mounted into the pilot bore without regard for the rotational orientation of the sliding pilot 40 with respect to the pilot bore. However, in other embodiments (not shown), the sliding pilot outer profile 52 is not circular (e.g., annular, elliptical, polygonal, undulating, etc).

Figure 4:
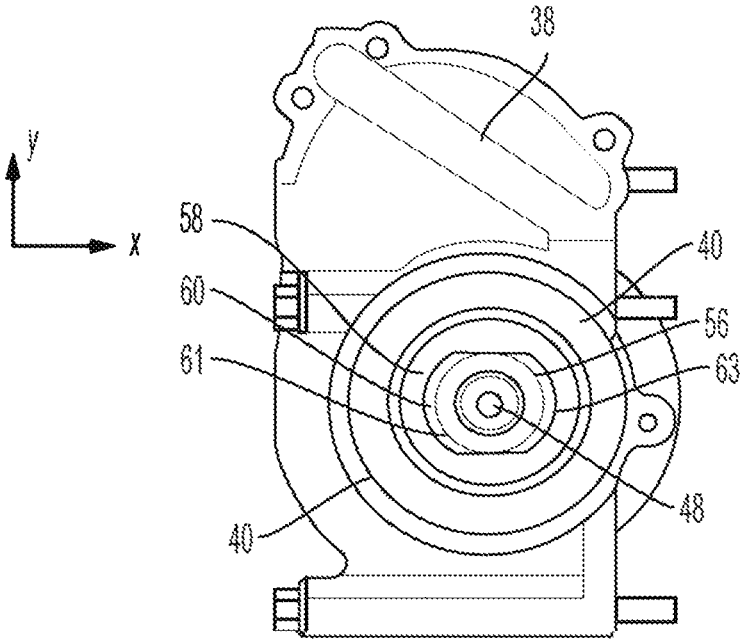
FIG. 4 is a back elevation view of the lube pump of FIG. 2 in a mounted position before being assembled with a gear drive according to an embodiment of the present disclosure.

Perhaps as best shown in FIG. 4 (not showing the drive mechanism and retaining nut), the example sliding pilot 40 is shown interfacing with a support boss 56 of the lube pump accessory 36. As shown, the support boss 56 is integrally formed in the pump housing 38. The example sliding pilot 40 does not rotate with the pump driveshaft 48.

In an "x-y" plane, a sliding pilot inner profile 58 circumscribes a support boss outer profile 60, which allows the sliding pilot 40 to slide onto and interface with the support boss 56. As shown, the sliding pilot inner profile 58 and the support boss outer profile 60 each include two straight edges (e.g., flats) and two curved edges (e.g., arcs) defining a "race track" style geometry. In the illustrated embodiment, the two straight edges extend in the "x" direction. However, other geometries facilitating sliding in the "x" direction while locating in the "y" direction are also contemplated.

The sliding pilot 40 is configured to facilitate locating the lube pump accessory 36 in the "y" direction while allowing a limited degree of freedom in the "x" direction. The example sliding pilot 40 is located in the "y" direction with respect to the example support boss 56 while also configured to slide back and forth for a limited travel distance in the "x" direction with respect to the support boss 56. The corresponding curved edges of each profile 58, 60 have complementary shapes. However, the straight edges of the sliding pilot inner profile 58 form a sliding fit with and have greater length than the corresponding straight edges of the support boss outer profile 60.

In this example configuration, in an "x-y" plane, at least one gap is formed between at least one of the corresponding curved edges, and the rotational orientation between the example sliding pilot 40 and the example support boss 56 is fixed. In the mounting position, the sliding pilot 40 is in a right-most position with respect to the support boss 56. In various embodiments, at the limit of rightward travel of sliding pilot 40, as allowed by the interface between the sliding pilot inner profile 58 and the support boss outer profile 60, a first gap 61 is maximized and a second gap 63 is minimized.

Figure 5:
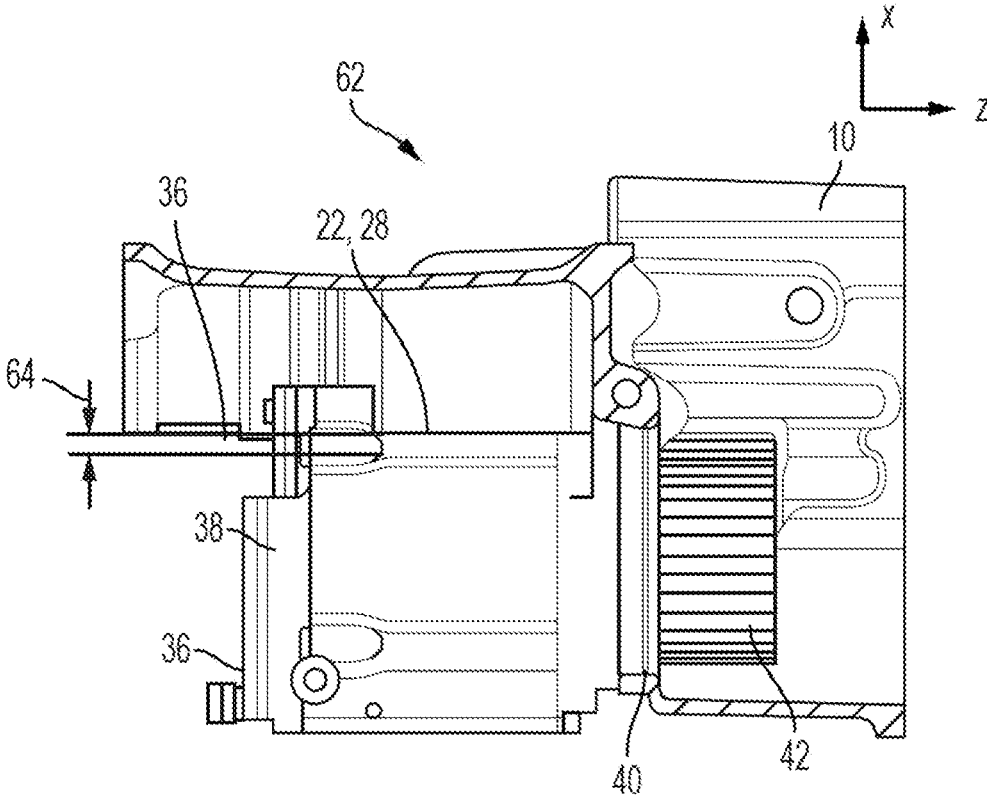
FIG. 5 is a top view of the lube pump in position to be mounted onto the engine block of FIG. 1 according to an embodiment of the present disclosure.

FIG. 5 shows a lube pump pre-assembly 62 including the example lube pump accessory 36 positioned near the example engine block 10 (e.g., before mounting). As illustrated, the sliding pilot 40 in a pre-mounting or pre-assembly position slides to a left-most position. A clearance 64 is defined having a width in the "x" direction between the sealing surfaces 22, 28 (FIG. 1) of the engine block 10 and the pump housing 38. In some embodiments, the width of the example clearance 64 is selected to make a space or gap available for avoiding damage to a sealing gasket between the pump housing 38 and the sealing surfaces 22, 28 while sliding the drive mechanism 42 in the "z" direction through the pilot bore 12 during mounting. Insufficient clearance may result in "raking" a sealing gasket with a rigid sealing surface or edge.

Figure 6:
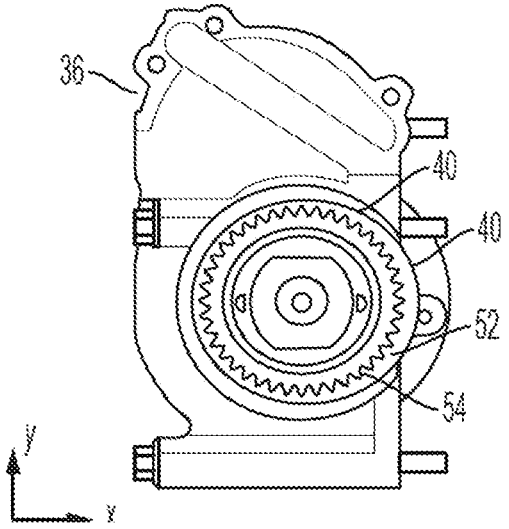
FIG. 6 is a back elevation view of the lube pump of FIG. 5 in a pre-mounting position according to an embodiment of the present disclosure.

Referring to FIG. 6 (not showing the engine block), the example lube pump accessory 36 is shown in pre-mounting or pre-assembly position. As shown, the sliding pilot 40 is at the limit of leftward travel. Even at the left-most position, the example sliding pilot outer profile 52 circumscribes a drive mechanism outer profile 54.

Figure 7:
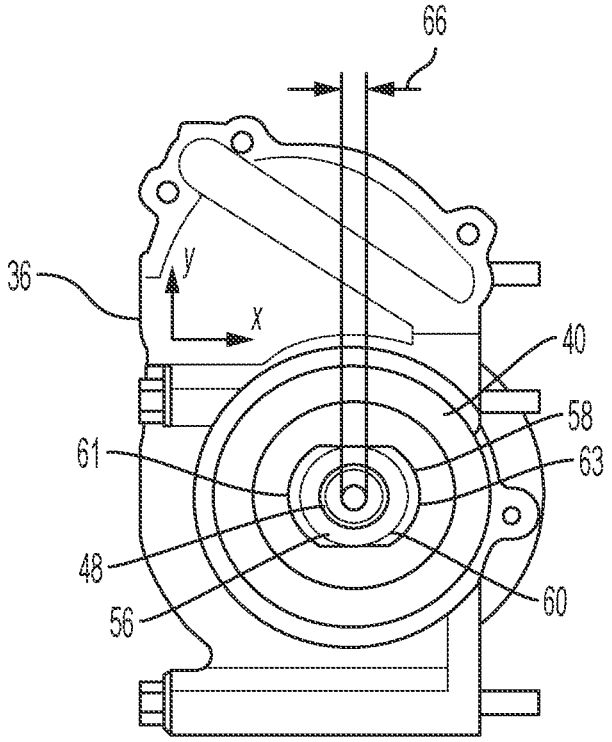
FIG. 7 is a back elevation view of the lube pump of FIG. 5 in a pre-mounting position before being assembled with a gear drive according to an embodiment of the present disclosure.

Referring now to FIG. 7 (not showing the drive mechanism and retaining nut), the sliding pilot 40 of the example lube pump accessory 36 in a pre-mounting or pre-assembly position is shown in relation to the support boss 56. In the pre-mounting position, the sliding pilot 40 is at a left-most position, as allowed by the interface between the sliding pilot inner profile 58 and the support boss outer profile 60, which minimizes the first gap 61 and maximizes the second gap 63 in various embodiments. As illustrated, the exterior profile of the sliding pilot 40 and the pump driveshaft 48 are not coaxially aligned before mounting, which defines an offset 66 between their centerlines.

Figure 8:
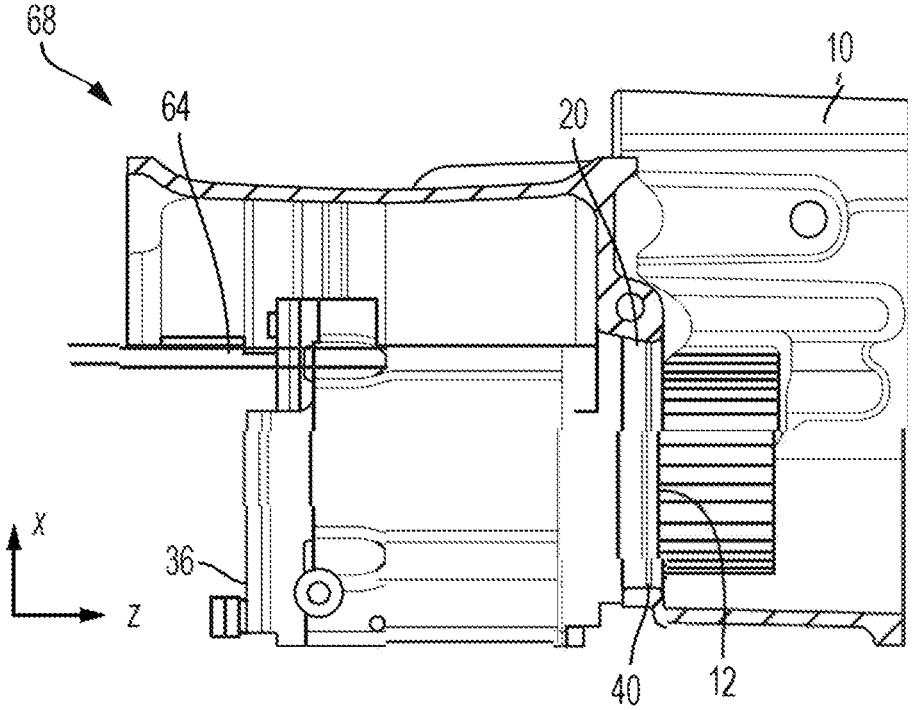
FIG. 8 is a top view of a lube pump being mounted onto the engine block of FIG. 1 according to an embodiment of the present disclosure.
Figure 9:
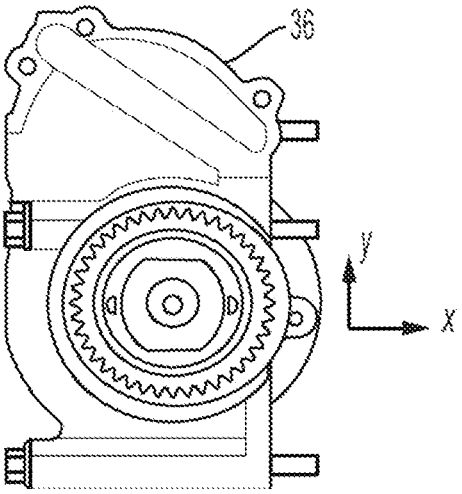
FIG. 9 is a back elevation view of the lube pump of FIG. 8 in a mounting position according to an embodiment of the present disclosure.

FIGS. 8 and 9 show an example lube pump assembly 68 during mounting. In particular, FIG. 8 shows the example lube pump accessory 36 in a mounting position relative to the engine block 10 with clearance 64 positioned between and being a phase between the pre-mounting position and the mounted position. FIG. 9 shows the example lube pump accessory 36 in the same position as FIG. 8, but without the engine block 10.

Similar to the pre-mounting position shown in FIGS. 5-7, the example sliding pilot 40 remains in a left-most position. Similar to the mounted position shown in FIGS. 2-4, the example drive mechanism 42 is inserted into the example engine block 10 and the example sliding pilot 40 interfaces in a sliding fit with the pilot bore 12 via the pilot bore interface 20. The example pilot bore interface 20 includes a taper, which compresses a pilot seal O-ring, such as pilot seal O-ring 82 of FIG. 10 described below, as the lube pump accessory 36 is inserted.

Figure 10:
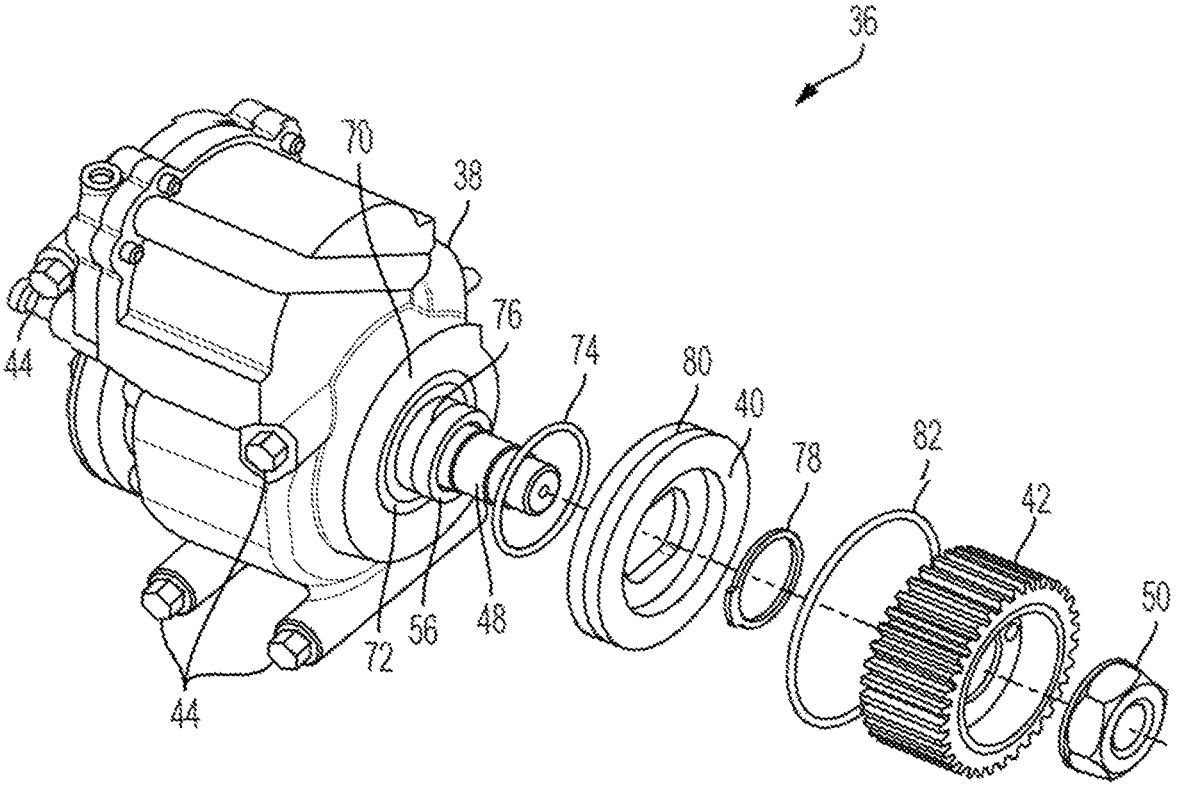
FIG. 10 is an exploded, isometric view of the left side of the lube pump of FIG. 1 according to an embodiment of the present disclosure.
Figure 11:
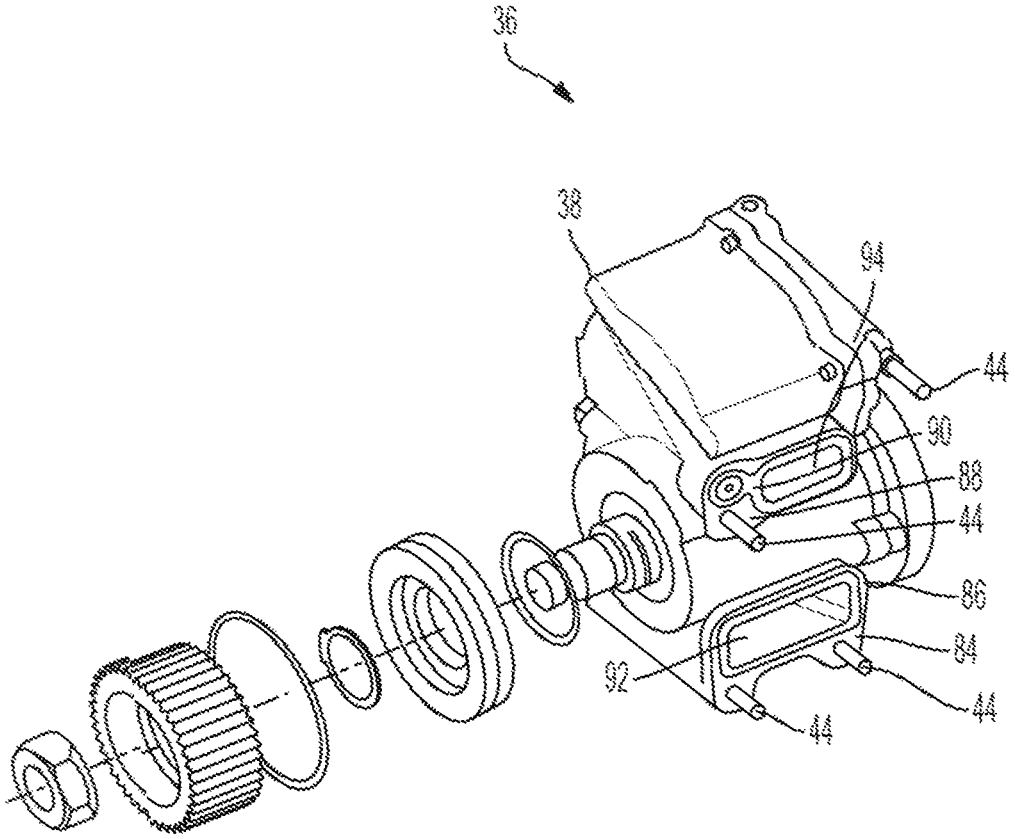
FIG. 11 is an exploded, isometric view of the right side of the lube pump of FIG. 1 according to an embodiment of the present disclosure.

Turning now to FIGS. 10 and 11, more detail of the example lube pump accessory 36 is shown in various exploded views. The sliding pilot 40 is formed separately from the pump housing 38 to facilitate the sliding fit described herein elsewhere. As shown, the pump housing 38 includes a "z" position surface 70, a face seal O-ring groove 72 formed in the "z" position surface for maintaining (e.g., retaining) an elastomeric face seal O-ring 74, the support boss 56 integrally formed with the pump housing, and a retaining ring groove 76 formed in the support boss for maintaining a retaining ring 78. During an example assembly, the face seal O-ring 74 is compressed between the "z" position surface 70 and a surface of the sliding pilot 40. The compression is maintained during operation by installing the retaining ring 78 in the retaining ring groove 76 with the sliding pilot 40 positioned between the retaining ring 78 and the "z" position surface 70. In additional or alternative embodiments, the sliding pilot 40 interfaces directly with the "z" position surface 70. Although the sliding pilot 40 compresses the face seal O-ring 74 and/or interfaces directly with the "z" position surface 70, the sliding pilot remains slidable in the "x" direction relative to the pump housing 38 during mounting, which may be facilitated by an applied lubricant, for example, such as oil.

The example sliding pilot 40 includes a pilot seal O-ring groove 80 formed in an outer surface of the sliding pilot for maintaining an elastomeric pilot seal O-ring 82. During an example assembly of the lube pump assembly 68 (FIGS. 8 and 9), the example pilot seal O-ring 82 is compressed between the outer surface of the sliding pilot 40 and a pilot bore interface (e.g., pilot bore interface 20). An applied lubricant may facilitate sliding the pilot seal O-ring 82 during mounting. A compressed pilot seal O-ring 82 seals a gear chamber (e.g., gear chamber 46) to prevent contaminants from entering from the environment around an engine block or leaving therefrom to the environment and/or to mitigate gear noise during operation.

In some embodiments, a pilot bore interface compresses the pilot seal O-ring 82 as the lube pump accessory 36 is inserted and slides into an engine block, for example, by having a tapered shape. However, other shapes for a pilot bore interface are also contemplated. Some example pilot bores include a shoulder for interfacing with a surface of the sliding pilot 40 and to facilitate locating in the "z" direction (e.g., the sliding pilot 40 directly interfaces with the "z" position surface 70 and the shoulder of the pilot bore).

In an example assembly of the lube pump accessory 36, after the retaining ring 78 is installed, the drive mechanism 42 is positioned over and configured to deliver rotational power to the pump driveshaft 48. The retaining nut 50 is secured to the pump driveshaft 48 to maintain the drive mechanism 42 on the pump driveshaft 48.

As shown in FIG. 11, the example pump housing 38 further includes an inlet "x" position surface (e.g., mounting surface) 84 configured to maintain an inlet seal gasket 86 and an outlet "x" position surface (e.g., mounting surface) 88 configured to maintain an outlet seal gasket 90. In the illustrated embodiment, the "x" position surfaces 84, 88 are co-planar or at least in parallel planes. A pump inlet 92 and a pump outlet 94 are formed in the inlet and outlet "x" position surfaces, respectively. The inlet 92 is configured to receive fluid for delivery to the outlet 94. The lube pump accessory 36 is configured to pressurize fluid at the outlet 94.

The example fasteners 44 are configured to secure a fully assembled lube pump accessory 36 to the engine block 10 and/or to locate the lube pump accessory 36 in the "x" direction with respect to an engine block.

Securing the example fasteners 44 also compresses the seal gaskets 86, 90. Compressed seal gaskets facilitate containment of the fluid flow into the pump inlet 92 and out of the pump outlet 94 at various pressures.

Yet further, securing the example fasteners 44 locates the lube pump accessory 36 in the "z" direction with respect to an engine block. In various embodiments, the fasteners 44 have a lower or looser tolerance when secured into fastener provisions in the "z" direction (e.g., a 1 mm tolerance) than in the "x" direction (e.g., 0.1 mm). For example, locating in the "x" direction is facilitated by the fixed and rigid "x" position surfaces 84, 88 interfacing with fixed and rigid sealing surfaces on the engine block 10.

The example lube pump accessory 36 when fully assembled is suitable for mounting or installation to the example engine block 10 (FIG. 1) without requiring external access to the gear chamber 46 (FIG. 2), which facilitates the ease of assembly and simplifies engine block design. Furthermore, the lube pump accessory 36 and engine block 10 are configured to precisely locate in the "x" and "y" directions to mitigate backlash or gear clearance. The thickness of the lube pump drive mechanism teeth mitigates issues with locating in the "z" direction, which may have a lower or looser tolerance than the "x" and "y" directions. Yet further still, fluid flowing through the engine block to and from the lube pump accessory is not restricted to a "z" surface, which enables geometries utilizing a fluid interface along "x" and/or "y" surfaces and may facilitate less tortuous fluid flow. Less tortuous fluid flow may reduce parasitic pumping losses, as well as improve fuel economy and management of fluid transfer pressure drop from an oil pan to a lube cooler, for example.

Figure 12:
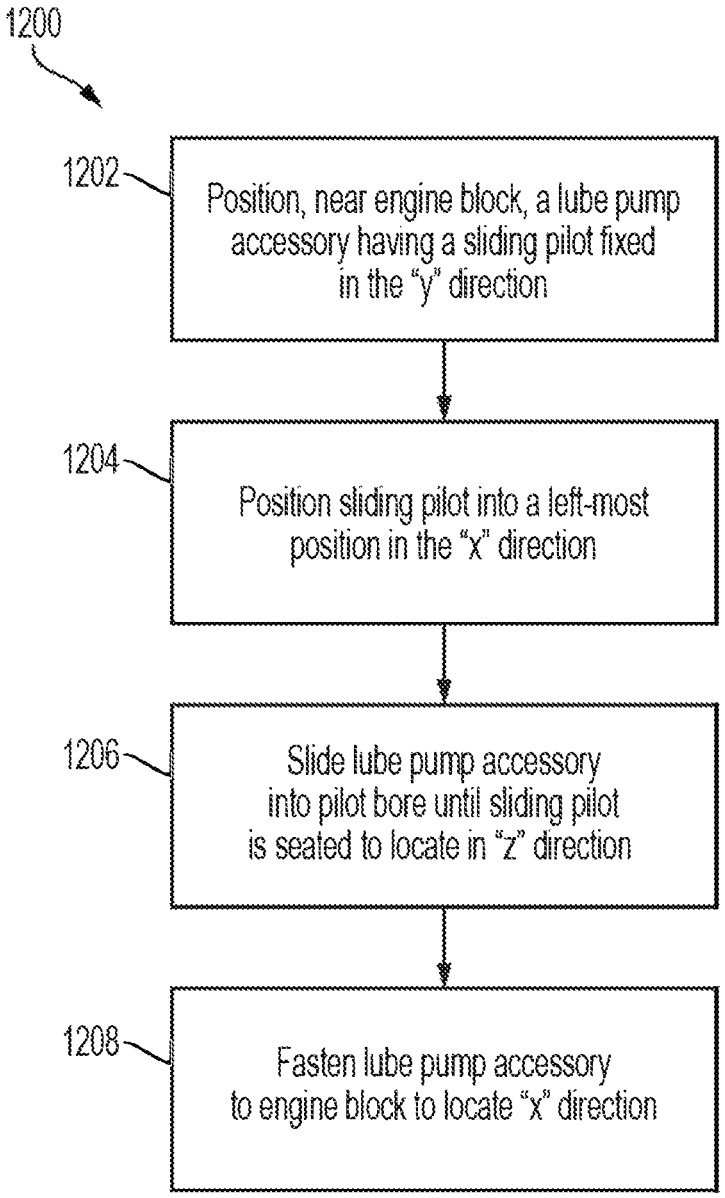
FIG. 12 is a process for mounting the lube pump to an engine block according to an embodiment of the present disclosure.

FIG. 12 shows an example process 1200 for mounting a lube pump accessory to an engine block, such as lube pump accessory 36 and engine block 10. In operation 1202, the assembled lube pump accessory is positioned near the engine block. The lube pump accessory has a sliding pilot that is fixed in the "y" direction with respect to housing of the lube pump accessory.

In operation 1204, the sliding pilot of the lube pump accessory is positioned in a pre-assembly position. The pre-assembly position is a left-most position of the sliding pilot in the "x" direction with respect to the lube pump housing.

In operation 1206, the lube pump accessory slides into a pilot bore of the engine block until the sliding pilot is seated and located in the "z" direction. Because the sliding pilot is fixed in the "y" direction, the "y" direction is also located. Part of the lube pump accessory is inserted into a gear chamber of the engine block. A drive mechanism of the lube pump accessory interfaces with an engine drive system housed in the engine block.

In operation 1208, the lube pump accessory is fastened to the engine block and located in the "x" direction. One or more fasteners, such as cap screws that mate to cap screw provisions formed in the engine block, are used for securing.

The above detailed description of the invention and the examples described therein have been presented for the purposes of illustration and description only and not by limitation. It is therefore contemplated that the present invention cover any and all modifications, variations, or equivalents that fall within the spirit and scope of the basic underlying principles disclosed above and claimed herein. As such, in the foregoing specification, specific embodiments of the present disclosure have been described. However, one of ordinary skill in the art will appreciate that various modifications and changes can be made without departing from the scope of the disclosure as set forth in the claims below. For example, while the embodiments described above refer to particular features, the scope of this invention also includes embodiments having different combinations of features and embodiments that do not include all of the above described features. Accordingly, the specification and figures are to be regarded in an illustrative, rather than a restrictive, sense. The benefits, advantages, solutions to problems, and any element(s) that may cause any benefit, advantage, or solution to occur or become more pronounced are not to be construed as critical, required, or essential features or elements of any or all the claims.

What is claimed is:

1. An engine, comprising:

an engine block including a pilot bore aligned to a first plane, a gear chamber exposed to the pilot bore, one or more engine block sealing surfaces aligned to a second plane orthogonal to the first plane, one or more fastener provisions, and one or more fluid conduits extending from the one or more engine block sealing surfaces;

an engine drive system at least partially housed in the engine block;

a lube pump accessory mounted to the engine block wherein the lube pump accessory comprises a pump housing, a drive mechanism, a sliding pilot, one or more pump sealing surfaces having a complementary shape to the one or more corresponding engine block sealing surfaces, an inlet extending from at least one of the one or more pump sealing surfaces, and an outlet extending from at least one of the one or more pump sealing surfaces, wherein the drive mechanism is mounted in the engine block, the sliding pilot interfaces with the pilot bore to establish a "z" position and a "y" position for the lube pump accessory with respect to the engine block, and wherein the sliding pilot is configured to travel in an "x" direction with respect to the pump housing during mounting of the lube pump accessory; and one or more fasteners positioned in the one or more fastener provisions of the engine block and securing the lube pump accessory to the engine block.

2. The engine of claim 1 wherein the one or more fasteners secure the lube pump accessory to the engine block in the "x" direction.

3. The engine of claim 1 comprising a clearance in the "x" direction between the one or more engine block sealing surfaces and the pump housing.

4. The engine of claim 1 wherein the pilot bore forms a sliding fit to allow travel of the sliding pilot in a "z" direction.

5. The engine of claim 1 wherein the one or more fluid conduits extending from the one or more engine block sealing surfaces comprise an inflow conduit extending through an inflow sealing surface and outflow conduit extending through an outflow sealing surface.

6. The engine of claim 5 wherein the one or more fastener provisions comprise at least two fastener provisions positioned on the inflow sealing surface, one fastener provision positioned on the outflow sealing surface, and one fastener provision positioned on another surface of the engine block.

7. The engine of claim 1 wherein the lube pump accessory comprises a pump driveshaft extending in the "z" direction and is at least partially inserted into the pilot bore.

8. The engine of claim 7 wherein the lube pump accessory comprises a retaining nut secured to the pump driveshaft securing the drive mechanism to the lube pump accessory in the "z" direction.

9. The engine of claim 1 wherein the established "x" and "y" positions are toleranced to mitigate gear backlash between the drive mechanism of the lube pump accessory and a drive train.

10. An accessory for mounting to an engine block, comprising:

a housing including a support boss, one or more mounting surfaces, and one or more fluid conduits extending from the one or more mounting surfaces;

a driveshaft extending from the support boss in a "z" direction for insertion into the engine block when mounting the accessory to the engine block;

a sliding pilot interfacing with the support boss, the sliding pilot being capable of travel in an "x" direction yet fixed in a "y" direction with respect to the support boss, the sliding pilot including an inner profile and an outer profile in an "x-y" plane; and one or more fasteners for securing the accessory to the engine block in the "x" direction.

11. The accessory of claim 10 wherein the support boss includes two flat surfaces along an outer profile.

12. The accessory of claim 11 wherein the inner profile of the sliding pilot includes two flat edges complementary to the two flat surfaces of the support boss and extending in the "x" direction.

13. The accessory of claim 11 wherein the inner profile of the sliding pilot and the outer profile of the support boss each include two curved edges.

14. The accessory of claim 10 wherein a retaining ring groove is formed in the support boss.

15. The accessory of claim 10 wherein the housing includes a face seal O-ring groove formed in the "z" position surface for maintaining an elastomeric face seal O-ring.

16. The accessory of claim 10 wherein the accessory comprises a retaining nut secured to the driveshaft securing the drive mechanism to the accessory in the "z" direction.

17. The accessory of claim 10 wherein the one or more mounting surfaces maintain one or more seal gaskets, wherein when the one or more fasteners secure the accessory to the engine block, the one or more seal gaskets are compressed between the one or more mounting surfaces and the engine block to form a fluid tight seal.

18. A method, comprising:

positioning an accessory near an engine block, the accessory comprising a sliding pilot having travel in an "x" direction yet fixed in a "y" direction;

positioning the sliding pilot into a mounting position for mounting on the engine block at a limit of travel in the "x" direction;

sliding the accessory into a pilot bore of the engine block in a "z" direction until the sliding pilot is seated in the pilot bore to locate the accessory in the "z" direction and the "y" direction with respect to the engine block;

fastening the accessory to the engine block in the "x" direction to locate the accessory in the "x" direction with respect to the engine block, wherein fastening the accessory moves the sliding pilot into a mounted position at another limit of travel in the "x" direction.

19. The method of claim 18 wherein the engine block includes one or more engine block sealing surfaces and the accessory includes one or more accessory sealing surfaces, the one or more engine block sealing surfaces having a complementary shape to the one or more accessory sealing surfaces, and wherein fastening the accessory to the engine block in the "x" direction comprises mating the one or more engine block sealing surfaces with the one or more accessory sealing surfaces.

20. The method of claim 19 wherein the one or more engine block sealing surfaces maintain one or more seal gaskets, and wherein sliding the accessory into the pilot bore of the engine block further comprises providing a clearance in the "x" direction to allow the sliding pilot to be seated in the pilot bore without damaging the one or more seal gaskets with the accessory.

* * * * *